US006648180B2

(12) United States Patent
Moon et al.

(10) Patent No.: US 6,648,180 B2
(45) Date of Patent: Nov. 18, 2003

(54) DUPLEX STOPPER-TYPE WATER DISPENSING AND WATER BOTTLE SUPPORTING APPARATUS

(75) Inventors: Young Mu Moon, Koonpo-si (KR); Son Kyu Lee, Ulwang-si (KR); Hyung Min Park, Anyang-si (KR)

(73) Assignee: Clover Company Ltd., Anyang-si (KR)

( * ) Notice: Subject to any disclaimer, the term of this patent is extended or adjusted under 35 U.S.C. 154(b) by 0 days.

(21) Appl. No.: 10/142,056

(22) Filed: May 10, 2002

(65) Prior Publication Data

US 2003/0094213 A1 May 22, 2003

(30) Foreign Application Priority Data

Nov. 19, 2001 (KR) ..... 2001-71891

(51) Int. Cl.[7] ..... B65B 3/04

(52) U.S. Cl. ..... 222/185.1; 222/83.5; 222/146.1; 222/189.09; 141/18; 141/286; 141/346; 141/352; 141/364; 62/389

(58) Field of Search ..... 222/185.1, 83.5, 222/189.09, 146.1, 146.6; 141/18, 21, 285, 286, 291, 292, 330, 346, 351–354, 363–366, 383, 386; 62/389–400

(56) References Cited

U.S. PATENT DOCUMENTS 4,991,635 A 2/1991 Ulm
5,273,083 A 12/1993 Burrows
5,289,854 A 3/1994 Baker et al.
5,361,942 A 11/1994 Salkeld et al.
5,370,270 A 12/1994 Adams et al.
5,431,205 A 7/1995 Gebhard
5,464,127 A 11/1995 Burrows
5,533,651 A 7/1996 Eddy et al.
5,647,416 A 7/1997 Desrosiers et al.
5,676,278 A 10/1997 Beyer et al.
5,957,316 A 9/1999 Hidding et al.
6,029,860 A 2/2000 Donselman et al.
6,193,113 B1 2/2001 Hidding

*Primary Examiner*—J. Casimer Jacyna
(74) *Attorney, Agent, or Firm*—Jacobson Holman PLLC

(57) ABSTRACT

The present invention relates to a duplex stopper-type water dispensing and water bottle supporting apparatus which is adapted to a water bottle-type water dispensing apparatus in which a water bottle is mounted in an upside down configuration for thereby effectively dispensing water. The above apparatus is formed of an upper water bottle receiving portion and a lower water draining pipe portion and is sealed by an O-ring. A water draining pipe formed of a plurality of guide plates is provided in a center of the water draining pipe portion, so that it is possible to implement a continuous and enhanced water draining operation based on a concurrent exchanging operation of water draining and air inflow in one pipe for thereby implementing a simple construction and easier cleaning.

16 Claims, 7 Drawing Sheets

DUPLEX STOPPER-TYPE WATER DISPENSING AND WATER BOTTLE SUPPORTING APPARATUS

BACKGROUND OF THE INVENTION

1. Field of the Invention

The present invention relates to a duplex stopper-type water dispensing and water bottle supporting apparatus and, in particular, to an improved duplex stopper-type water dispensing and water bottle supporting apparatus which is adapted to a water bottle-type water supply apparatus in which a water bottle is mounted in an upside down configuration to thereby supply the water to the outside, so that it is possible to implement water discharge and air inflow concurrently in one pipe, thereby decreasing fabrication cost and implementing an easier cleaning operation.

2. Description of the Background Art

Generally, a duplex stopper-type water dispensing and water bottle supporting apparatus is basically directed to supplying water from a water bottle which is mounted upside down in a water bottle-type water supply apparatus, to a water storing container using a sanitary method.

Drinking water stored in a 5-gallon water bottle having a duplex stopper is commonly used today. In order to effectively access such drinking water, a duplex stopper-type water dispensing and water bottle supporting apparatus is installed on an upper portion of a water bottle-type water supply apparatus. A water storing container is installed in a lower portion of the same. When the water bottle is mounted upside down, the water storing container is filled through a draining pipe of the water dispensing and water bottle supporting apparatus, and the above water is provided to a user through a water discharging tap.

According to U.S. Pat. Nos. 5,647,416 and 5,289,854, in order to prevent water from being polluted, various duplex stopper-type water dispensing and water bottle supporting apparatuses are introduced.

In a conventional art, a conventional water bottle-type water supply apparatus 10 includes a water storing container for storing a certain amount of water therein, a cooling apparatus for supplying a cooled water, and a heating apparatus for supplying a heated water. A water discharging tap 11 is installed in an outer side of the water supply apparatus. A water bottle 20 is inserted upside down on an upper open side of the water storing container for thereby supplying a certain amount of water based on the principle of atmospheric pressure.

However, the above apparatuses have disadvantages in that it is impossible to implement an efficient water draining operation due to an alternating exchange of water and air in one pipe. A complicated apparatus capable of separating the water draining pipe and the air inflow pipe may be used, but this increases the fabrication cost.

SUMMARY OF THE INVENTION

Accordingly, it is an object of the present invention to provide a duplex stopper-type water dispensing and water bottle supporting apparatus which overcomes the problems encountered in the conventional art.

It is another object of the present invention to provide a duplex stopper-type water dispensing and water bottle supporting apparatus which is capable of partially separating the air from a water bottle and the water from the water bottle in one pipe when the water is discharged from the water bottle having a duplex stopper to thereby implement an efficient water discharging operation and also supply sanitized water by purifying the air which flows into the interior of the water storing container.

To achieve the above objects, the present invention is directed to a duplex stopper-type water dispensing and water bottle supporting apparatus which includes a water discharging tap in an outer side of a casing, a cooling apparatus installed in the casing for supplying a cooled water, a heating apparatus for supplying a heated water and a water storing container for storing a certain amount of water therein, wherein the duplex stopper-type water dispensing and water bottle supporting apparatus is installed in a water bottle-type water supply apparatus in which a water bottle is mounted upside down for thereby supplying a certain amount of water based on the principle of atmospheric pressure. The duplex stopper-type water dispensing and water bottle supporting apparatus according to the invention is constructed such that an upper water bottle receiving portion and a lower water draining pipe portion are separable and are sealed by an O-ring. A circular shoulder portion and a rounded head are formed in a center of the water draining pipe portion for fixedly inserting an inner stopper of a duplex stopper in an upper portion of the same, and a water draining pipe has at least two water draining apertures in a lower lateral surface thereof. A plurality of guide plates are formed in the interior of the water draining pipe to form a plurality of water draining channels, and a water bottle supporting shoulder portion and an air inlet portion are formed in one side of the water bottle receiving portion. An air filtering apparatus is also provided for filtering and supplying air which flows in through the air inlet portion.

In the water draining pipe, the plurality of guide plates are installed to bisect the water draining apertures and to separate the water draining apertures in parallel with the water draining pipe, and a water spreading prevention shoulder portion is formed in a lower portion of such pipe.

The air filtering apparatus includes a casing having an air path formed in a lateral portion and a filter installed in the interior of the same. A check valve is installed in a lower portion of the apparatus for opening and closing an air hole based on a buoyancy.

BRIEF DESCRIPTION OF THE DRAWINGS

The present invention will become better understood with reference to the accompanying drawings which are given only by way of illustration and thus are not limitative of the present invention, wherein;

FIGS. 4A through 4C are cross-sectional views illustrating the construction of a water draining pipe according to the present invention, of which:

FIG. 4A is a front cross-sectional view;

FIG. 4B is a side cross-sectional view; and

FIG. 4C is a cross-sectional view taken along line A–A' of FIG. 4A;

FIGS. 5A through 5C are cross-sectional views illustrating a process whereby a water bottle is mounted upside down in a water dispensing and water bottle supporting apparatus according to the present invention, of which:

FIG. 5A is a view illustrating a state before the water bottle is inserted;

FIG. 5B is a view illustrating a state when the water bottle is partially inserted; and FIG. 5C is a view illustrating a state when the water bottle is fully inserted;

DETAILED DESCRIPTION OF THE PREFERRED EMBODIMENTS

The preferred embodiments of the present invention will be explained with reference to the accompanying drawings.

A duplex stopper-type water dispensing and water bottle supporting apparatus according to the present invention is installed on an upper portion of a water storing container 12 of a water bottle-type water supply apparatus 10. A water bottle 20 having a duplex stopper 30 is inserted into the upper portion of the water storing container 12 in an upside down configuration, so that the water is supplied from the water bottle 20 to the water storing container 12.

Figure 1:
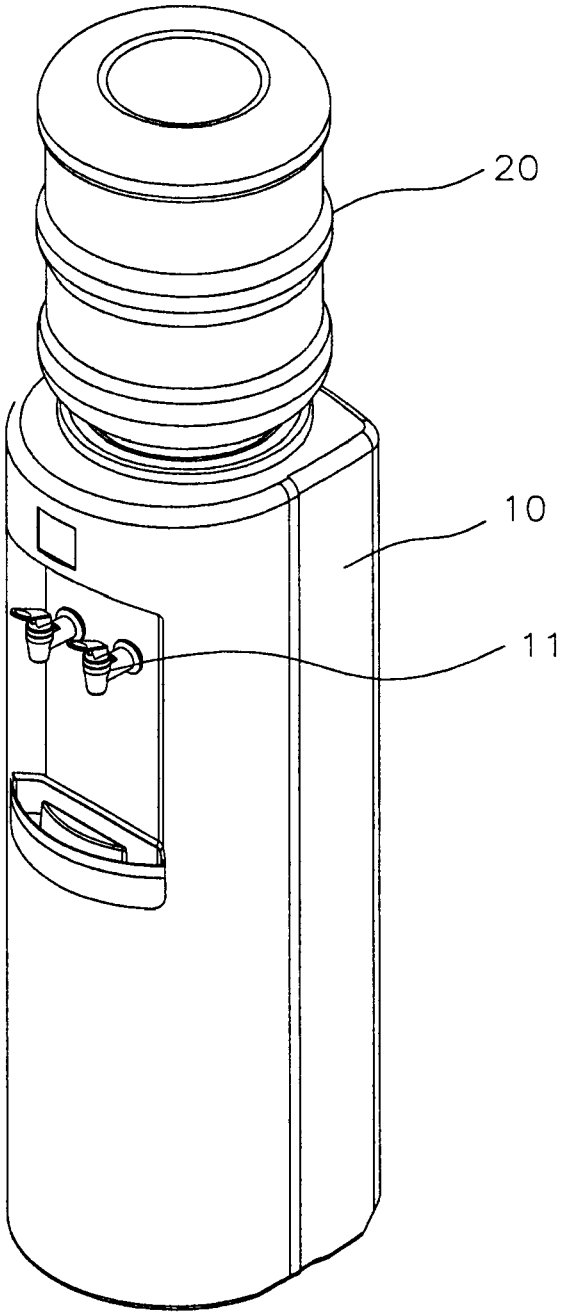
FIGURE 1 (PRIOR ART)
FIG. 1 is a perspective view illustrating conventional water bottle type water supply apparatus.
Figure 2:
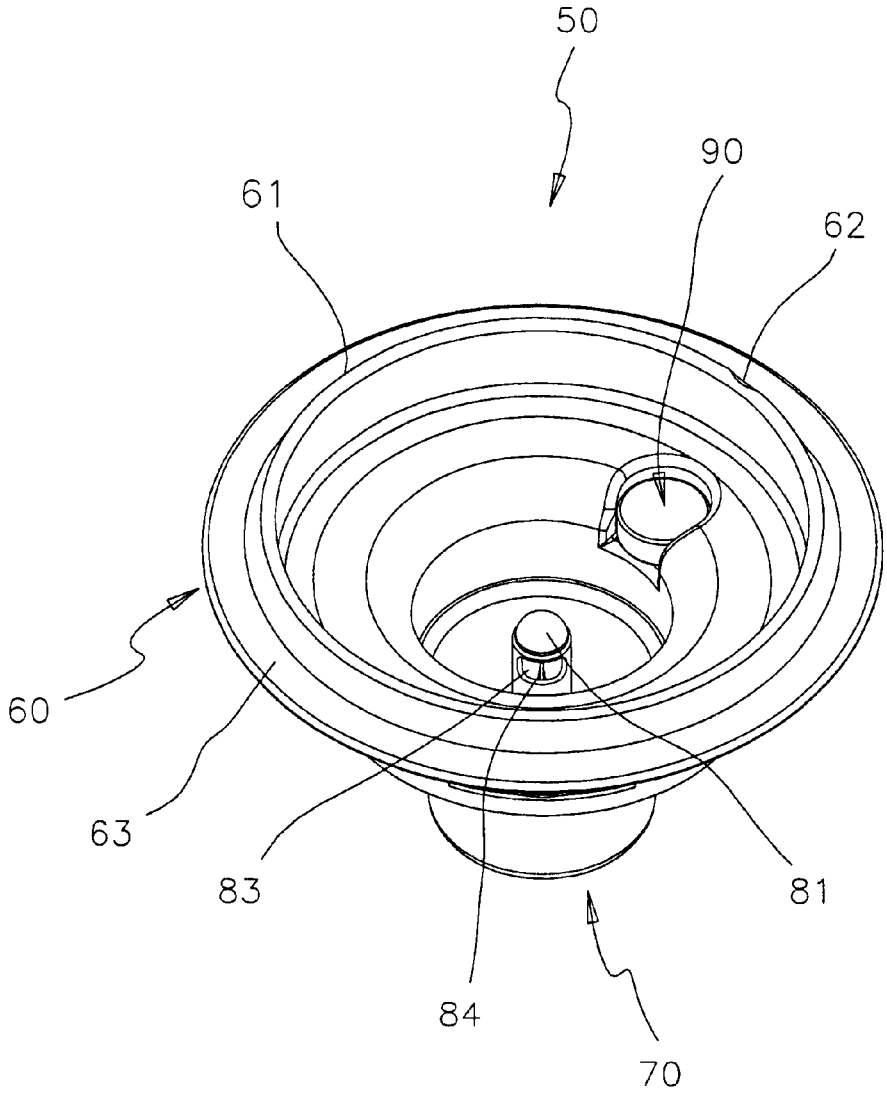
FIG. 2 is a perspective view illustrating a duplex stopper-type water dispensing and water bottle supporting apparatus according to the present invention.
Figure 3:
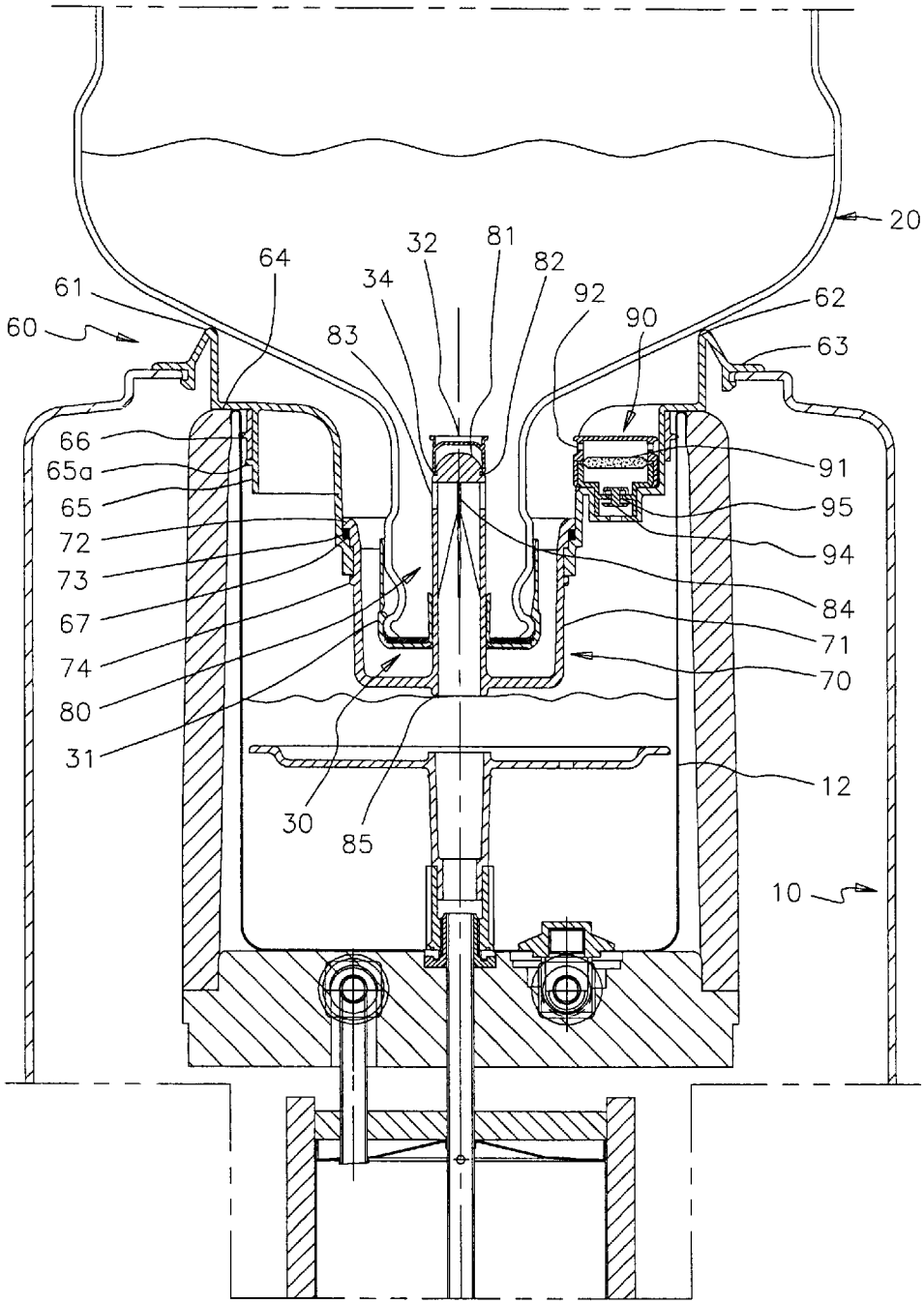
FIG. 3 is a cross-sectional view illustrating the duplex stopper-type water dispensing and water bottle supporting apparatus with water bottle and water supply apparatus according to the present invention.

As shown in FIGS. 2 and 3, the duplex stopper-type water dispensing and water bottle supporting apparatus includes an upper water bottle receiving portion 60 and a lower water draining pipe portion 70 which are sealingly engaged by an O-ring 73.

The water bottle receiving portion 60 includes an air filtering apparatus 90 for filtering air which is drawn in when the water is discharged from the water bottle 20. The water draining pipe portion 70 includes a water draining pipe 80 for supplying the water from the water bottle 20 to the water storing container.

The operations of the duplex stopper 30 and the water draining pipe 80 will be explained.

Figure 5A:
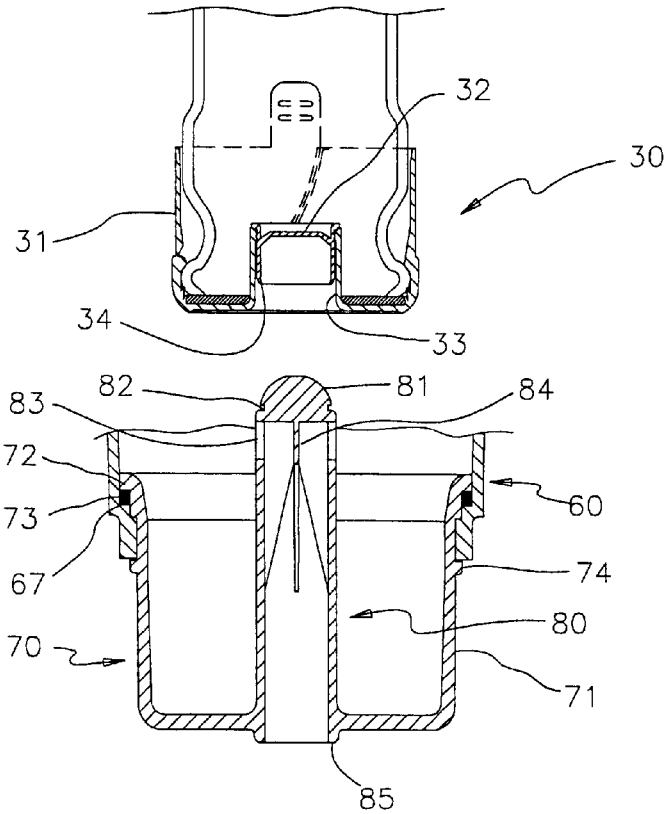

As shown in FIG. 5A, the duplex stopper 30 of the water bottle 20 adapted to the water bottle type water supply apparatus 10 is formed of a smooth plastic material, and an outer stopper 31 seals a bottle neck of the water bottle 20, and an inner stopper 32 is tightly inserted into an upper portion of a central sleeve 33 for thereby sealing the water bottle 20.

Figure 5B:
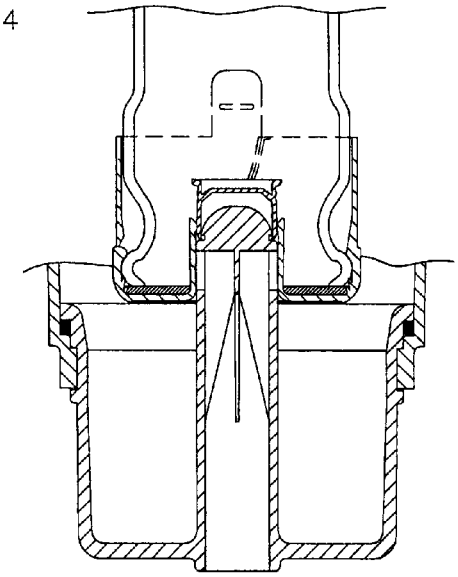
Figure 5C:
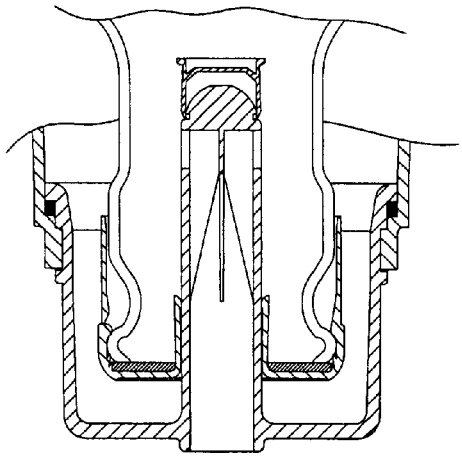

The process whereby that the water bottle 20 having a duplex stopper 30 is mounted on the water dispensing and water bottle supporting apparatus 50 installed in the water bottle-type water supply apparatus 10 in an upside down configuration will be explained with reference to FIGS. 5A, 5B and 5C.

When the water bottle 20 is held upside down, the duplex stopper 30 is mounted on a rounded head 81 above the water draining pipe 80 of the water dispensing and water bottle supporting apparatus 50, so that the sleeve 33 is inserted into the water draining pipe 80.

At this time, the inner stopper 32 is guided by the rounded head 81 of the front end of the water draining pipe 80, and a circular shoulder portion 34 of the end portion of the inner stopper 32 is engaged with a circular shoulder portion 82 below the rounded head 81.

The sleeve 33 is closely contacted with an outer wall of the water draining pipe 80 and is moved downwardly. The inner stopper 32 is engaged with the circular shoulder portion 82 and is pushed upwardly and freed from the sleeve 33.

The sleeve 33 is moved down onto a water draining portion 83 formed in a lateral upper portion of the water draining pipe 80, and the water bottle 20 is engaged by a water bottle engaging shoulder portion 61 of the water bottle receiving portion 60.

In this state, air is inputted into the interior of the water bottle 20, and the water is drawn into the water storing container 12 through the water draining portion 83 and the water draining pipe 80.

When the water in the storing container 12 rises to the height of a water spreading prevention shoulder portion 85 in a lower portion of the water draining pipe 80 which extends into the interior of the water storing container 12, air is no longer able to enter the water bottle 20. A negative pressure is increased in the empty space within the upper portion of the water bottle 20. The above negative pressure is balanced with the weight of the water due to gravity, so that the supply of water is stopped.

When removing the water bottle 20 from the water bottle-type water supply apparatus 10, the inner stopper 32 inserted into the circular shoulder portion 82 of the water draining pipe 80 is re-engaged with the sleeve 33 to thereby seal the water bottle 20.

Figure 4A:
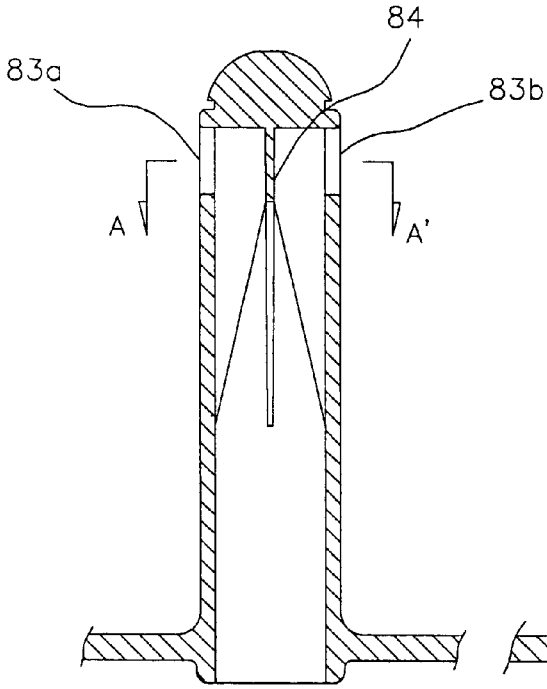
Figure 4B:
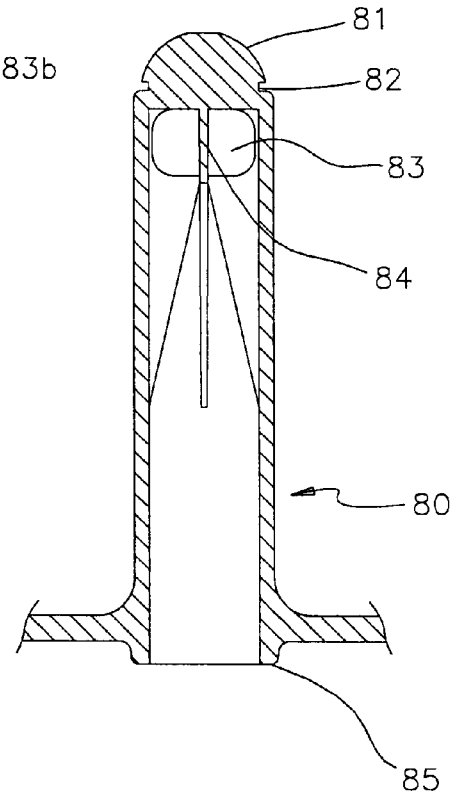
Figure 4C:
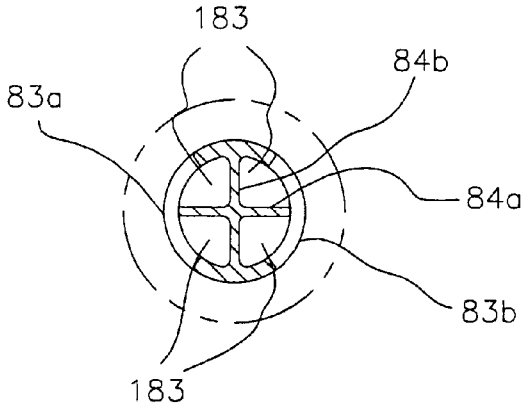

As shown in FIG. 4, the water draining pipe 80 includes a rounded head 81 at an upper end thereof with a circular shoulder portion 82 below the head 81. In the pipe 80, two opposing water draining apertures 83*a*, 83*b* are formed through which water flows to the upper side surface, and two intersecting guide plates 84*a*, 84*b* are installed therein. A first guide plate 84*a* bisects each of the water draining apertures 83*a*, 83*b* and a second guide plate 84*b* separates one water draining aperture 83*a* from the other water draining aperture 83*b*.

Since each water draining aperture 83*a*, 83*b* is divided by the first guide plate 84*a*, four water draining channels 183 are totally formed.

The guide plates 84 are connected to each other adjacent to the water draining portion 83 and then taper toward the inner wall of the water draining pipe 80 in an oblique line shape in a lower direction relative to the head 81. Through such taper, each guide plate splits into the lower portions, as shown in FIGS. 4A and 4B.

The second guide plate 84*b* as connected adjacent the water draining apertures 83*a*, 83*b*, prevents the water inputted into the water draining apertures 83*a*, 83*b* from being mixed. The first guide plate 84*a* with its lower tapered portions formed to bisect the water draining apertures 83*a*, 83*b* helps the water inputted into the water draining apertures to flow along the inner wall of the water draining pipe 80 based on an adhesive force of the water flowing into the water draining apertures.

At this time, a certain space is formed in the center of the water draining pipe 80 which is used as a flow path through which air flows into the water bottle 20.

The water in the water bottle 20 surges in response to incoming air, and the shape and position of the air path are changed based on the shape of the water stream which flows along the inner wall of the water draining pipe 80.

The air flows into the water bottle 20 through a certain water draining channel 183 based on the above change, and the water is drained through the remaining water draining channels 183. Therefore, the water is continuously and smoothly discharged based on the concurrent exchange operation of the water and air in one pipe 80.

As noted earlier, in the conventional water draining apparatus, it is impossible to implement an efficient water draining operation due to the alternating exchange operation of the water and air in one pipe; alternatively, a complicated apparatus capable of separating an air inflow pipe and water draining pipe is additionally needed.

As shown in FIG. 3, the water bottle receiving portion 60 into which the water bottle 20 is inserted in an upside down configuration is positioned in a center upper portion of the water storing container 12 and includes a narrow cylindrical shape in a lower portion of the same for thereby guiding the bottle neck into a center portion.

An outer wing 63 covers an upper hole of the water bottle type water supply apparatus 10, and a water bottle mounting shoulder portion 61 is formed in an inner upper portion of the outer wing 63. A part of the shoulder portion is formed in a lower portion for thereby forming an air inlet portion 62.

An intermediate shoulder portion 64 is positioned on the upper portion of the water storing container 12 for thereby supporting the weight of the water bottle 20 and preventing a foreign substance from being inserted into the water storing container 12.

A circular vertical wing 65 is formed in an inner lower portion of the intermediate shoulder portion 64. A packing 66 is inserted onto the same for implementing a tight engagement with an upper inner side of the water storing container 12, so that it is possible to effectively seal the water storing container 12.

A shoulder portion 65*a* is formed in a lower portion of the circular vertical wing 65 for preventing an escape of the packing 66.

A hole communicating with the water storing container 12 is formed in an inner side of the circular vertical wing 65. An air filtering apparatus 90 is installed therein for filtering the air needed when draining the water from the water bottle 20.

An inner circular shoulder portion 67 is formed in a cylindrical inner end portion of a lower portion of the water bottle receiving portion 60 for engaging with the water draining pipe portion 70.

As shown in FIG. 3, the water draining pipe portion 70 is cylindrically formed about the vertical water draining pipe 80 and, engaged with a lower portion of the water bottle receiving portion 60, is positioned in the interior of the water storing container 12.

A water spreading prevention shoulder portion 85 communicating with the water draining pipe 80 is installed in a bottom for preventing water from the water bottle 20 from being spread.

The inner diameter of a cylindrical vertical extension 71 is slightly larger than the outer diameter of the duplex stopper 30 for implementing an easier engagement and disengagement of the duplex stopper 30.

A circular shoulder portion 72 is outwardly formed in an upper end portion of the cylindrical vertical extension 71, and a plurality of shoulder portions 74 are formed below the same. An O-ring 73 is inserted between the shoulder portions 67, 72 for thereby sealingly engaging the water draining pipe portion 70 with the water bottle receiving portion 60.

Figure 7:
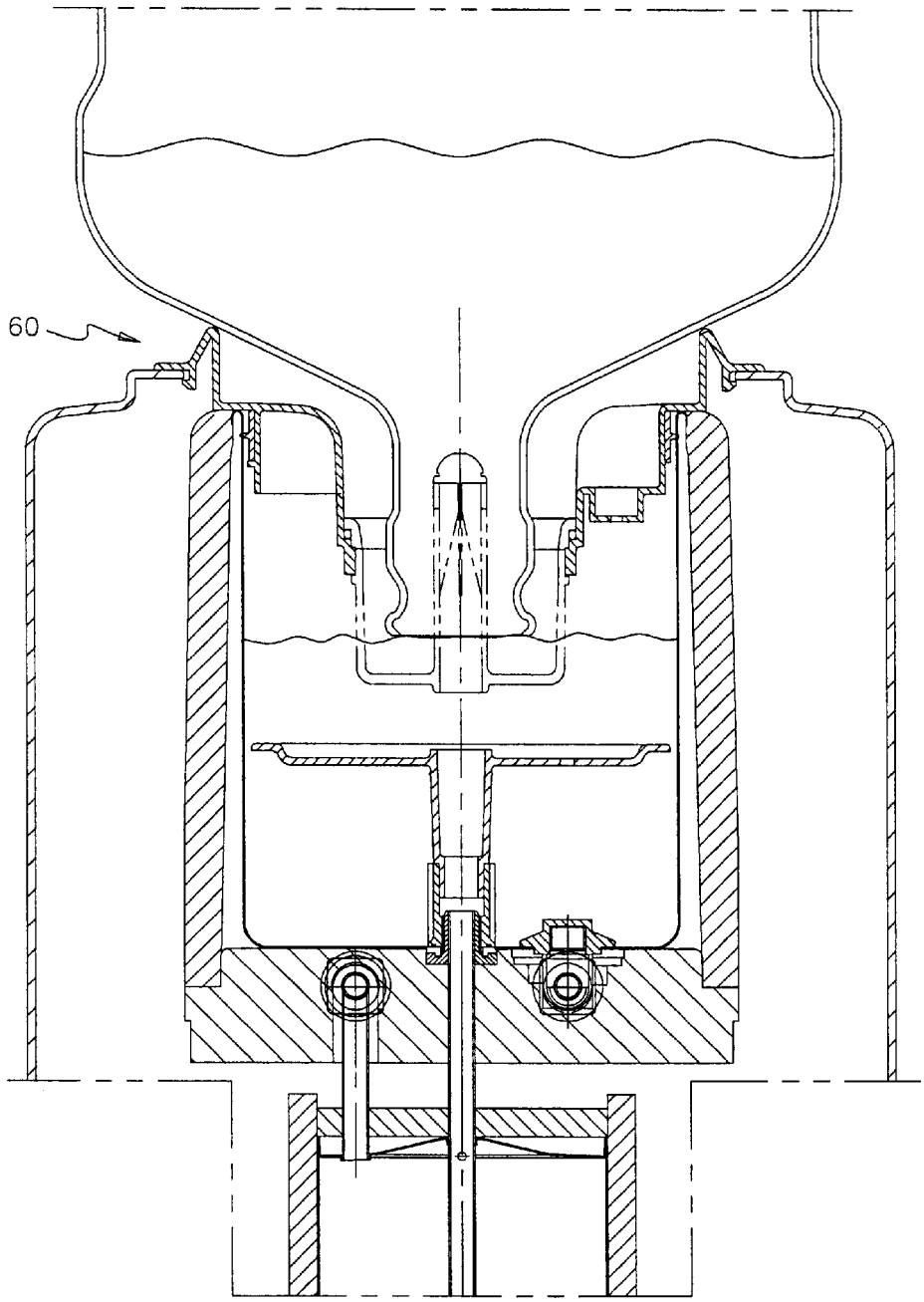
FIG. 7 is a cross-sectional view illustrating an alternative embodiment in which a water bottle, from which the stopper has been removed, is mounted upside down such that only an upper water bottle receiving portion is installed in the water dispensing and water bottle supporting apparatus according to the present invention.

The duplex stopper-type water dispensing and water bottle supporting apparatus may be divided into the water bottle receiving portion 60 and the water draining pipe portion 70. Therefore, the present invention may be adapted to a duplex stopper-type water dispensing and water bottle supporting apparatus as well as a water bottle having a common stopper. In this case, as shown in FIG. 7, the common stopper of the water bottle 20 is removed and is inserted upside down into the water bottle receiving portion 60. In this configuration, it is possible to quickly use the system by simply removing the water draining pipe portion 70.

Figure 6:
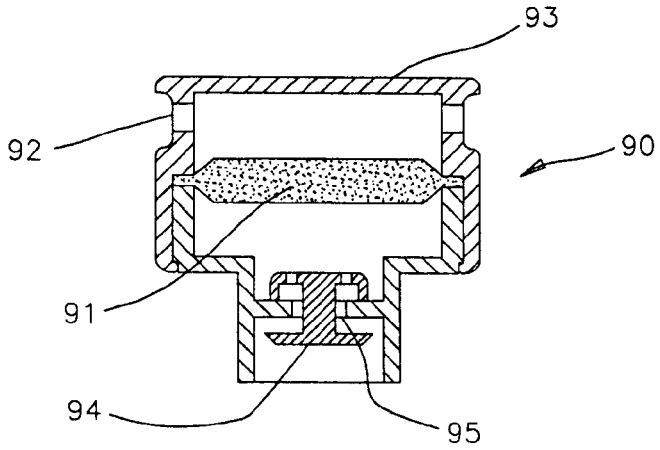
FIG. 6 is a cross-sectional view illustrating an air filtering apparatus according to the present invention.

As shown in FIG. 6, in the air filtering apparatus 90, a filter 91 is installed in the interior of a casing 93 in which an air path 92 is formed. The air flowing in through the air path 92 is filtered by the filter 91 and is supplied to the water storing container 12 through a lower check valve 94 and an air hole 95.

In the event that a water bottle 20 having a small hole due to damage is installed in the water supply apparatus 10, air is freely inputted into the water bottle 20, so that the draining operation of the water in the water bottle 20 is not controlled by the water level of the water storing container 12. As a result, the water may fully fill the sealed water storing container 12 and overflow beyond the air filtering apparatus 90. The check valve 94 is installed to prevent such an occurrence.

The check valve 94, which is formed of a smooth material, is forcibly inserted into the air hole 95 and is installed in a hanging state. During normal operation, the check valve is downwardly moved to thereby implement a smooth circulation of air. In the case of too much water in the container, the check valve 94 is moved upwardly and covers the air hole 95, thereby preventing water from overflowing beyond the water storing container 12.

The inflow of external air for a draining operation in the duplex stopper-type water dispensing and water bottle supporting apparatus 50 will be summarized as follows. The external air flows into the water storing container 12 through the air inlet portion 62 formed in the water bottle mounting shoulder portion 61 and the filter 91 of the air filtering apparatus and flows into the water bottle 20 through the center of the water draining pipe 80.

The draining operation of the duplex stopper-type water dispensing and water bottle supporting apparatus 50 will be summarized as follows. The water in the water bottle 20 is guided by the guide plates 84 through the water draining apertures 83 and flows into the water storing container 12 along an inner wall of the water draining pipe 80.

Therefore, in the present invention, it is possible to implement a smooth water draining operation based on a concurrent exchange operation of the water draining and air inflow in one pipe.

FIG. 7 is a cross-sectional view illustrating an alternative embodiment with a water bottle from which the stopper is removed, mounted in an upside down configuration in a state such that only a water bottle receiving portion is installed in the water dispensing and water bottle supporting apparatus according to the present invention.

As described above, in the present invention, when downwardly dispensing the water from the water bottle mounted in the water bottle-type water supply apparatus to the water storing container, it is possible to implement a smooth water draining operation based on a concurrent operation of a water draining and air inflow in one pipe. Therefore, in the present invention, construction is simplified, and fabrication cost is decreased. A cleaning operation is also easily performed. The present invention is well adapted to a sanitizing apparatus.

As the present invention may be embodied in several forms without departing from the spirit or essential characteristics thereof, it should also be understood that the above-described embodiments are not limited by any of the details of the foregoing description, unless otherwise specified, but rather should be construed broadly within the spirit and scope of the invention as defined in the appended claims, and therefore all changes and modifications that fall within the metes and bounds of the claims, or equivalents of such metes and bounds are therefore intended to be embraced by the appended claims.

What is claimed is:

1. In a duplex stopper-type water dispensing and water bottle supporting apparatus which includes a water discharging tap in an outer side of a casing, a cooling apparatus installed in the casing for supplying a cooled water, a heating apparatus for supplying a heated water and a water storing container for storing a certain amount of water therein, said duplex stopper-type water dispensing and water bottle supporting apparatus being installed in a water bottle-type water supply apparatus in which a water bottle is mounted in an upside down configuration for thereby supplying a certain amount of water based on a principle of atmospheric pressure, an improved duplex stopper-type water dispensing and water bottle supporting apparatus comprising:

an upper water bottle receiving portion and a lower water draining pipe portion which are separable and are sealed by an O-ring;

a circular shoulder portion and a rounded head formed in the water draining pipe portion for fixedly inserting an inner stopper of a duplex stopper in an upper portion of said water draining pipe portion;

a water draining pipe having a plurality of water draining apertures as well as a plurality of water draining channels in a lower lateral surface of said pipe;

a plurality of guide plates formed in an interior of the water draining pipe; and a water bottle supporting shoulder portion and an air inlet portion formed in one side of the water bottle receiving portion; and an air filtering apparatus for filtering and supplying air which flows in through the air inlet portion.

2. The apparatus of claim 1, wherein plurality of guide plates includes a first guide plate installed to bisect the water draining apertures and a second plate installed to separate the water draining apertures in parallel with the water draining pipe, and a water spreading prevention shoulder portion is formed in a lower portion of said water draining pipe.

3. The apparatus of claim 1, wherein said guide plates of the water draining pipe are connected to each other in an upper portion of said pipe, each guide plate dividing into two halves which taper in a lower direction and are integrated with the water draining pipe.

4. The apparatus of claim 1, wherein said air filtering apparatus includes a casing having an air path formed in a lateral portion, a filter, and a check valve installed in a lower portion of said filtering apparatus for opening and closing an air hole based on a buoyancy.

5. In a duplex stopper-type water dispensing and water bottle supporting apparatus which includes a water discharging tap in an outer side of a casing and a water storing container for storing an amount of water therein, said duplex stopper-type water dispensing and water bottle supporting apparatus being installed in a water bottle-type water supply apparatus in which a water bottle is mounted in an upside down configuration for thereby supplying water based on atmospheric pressure, an improved duplex stopper-type water dispensing and water bottle supporting apparatus comprising:

an upper water bottle receiving portion separably sealed to a lower water draining pipe portion by an O-ring, said upper water bottle receiving portion including an air inlet;

a water draining pipe within said lower water draining pipe portion, said water draining pipe having a rounded head and a circular shoulder portion beneath said rounded head for fixedly inserting an inner stopper of a duplex stopper in an upper portion of said pipe;

a plurality of water draining apertures in a side of said pipe adjacent and beneath said circular shoulder portion, said water draining apertures allowing water to flow into an interior of said pipe when said pipe is inserted into a water bottle;

a plurality of guide plates formed in said interior of said water draining pipe, said plurality of guide plates forming a plurality of water draining channels; and an air filtering apparatus coupled to said upper water bottle receiving portion for filtering and supplying air flowing in through said air inlet.

6. The apparatus as set forth in claim 5, wherein said plurality of water draining apertures includes two apertures substantially equal in size and equidistantly spaced from one another so as to be on opposing sides of said pipe.

7. The apparatus as set forth in claim 6, wherein said plurality of guide plates include a first guide plate and a second guide plate, said first guide plate extending from one aperture to the other aperture so as to substantially bisect said apertures, and said second guide plate being substantially perpendicular to said first guide plate so as to form a barrier separating said apertures in an approximate center of said pipe.

8. The apparatus as set forth in claim 7, wherein each guide plate extends from one side of said pipe to an opposite side thereof in an upper portion of said pipe, each guide plate dividing thereunder into two halves which taper in a downward direction toward the sides of said pipe and are integrated with said pipe.

9. The apparatus as set forth in claim 5, wherein each guide plate extends from one side of said pipe to an opposite side thereof in an upper portion of said pipe, each guide plate dividing thereunder into two halves which taper in a downward direction toward the sides of said pipe and are integrated with said pipe.

10. The apparatus as set forth in claim 5, wherein said air filtering apparatus includes a check valve for opening and closing an air hole based on buoyancy, a force of rising water against a base of said check valve causing said valve to rise and thereby close said air hole.

11. In a duplex stopper-type water dispensing and water bottle supporting apparatus which includes a water storing container for storing an amount of water therein, said duplex stopper-type water dispensing and water bottle supporting apparatus being installed in a water bottle-type water supply apparatus in which a water bottle is mounted in an upside down configuration for thereby supplying water to the water storing container based on atmospheric pressure, an improved duplex stopper-type water dispensing and water bottle supporting apparatus comprising:

an upper water bottle receiving portion separably sealed to a lower water draining pipe portion by an O-ring, said upper water bottle receiving portion including an air inlet and an air filtering apparatus;

a water draining pipe within said lower water draining pipe portion, said water draining pipe having a plurality of water draining apertures in an upper side portion of said pipe to allow water to flow into an interior of said pipe when said pipe is inserted into a water bottle; and a plurality of guide plates formed in said interior of said water draining pipe, said plurality of guide plates forming a plurality of water draining channels through which water and air can flow concurrently during a water draining operation.

12. The apparatus as set forth in claim 11, wherein said plurality of water draining apertures includes two apertures substantially equal in size and equidistantly spaced from one another so as to be on opposing sides of said pipe.

13. The apparatus as set forth in claim 12, wherein said plurality of guide plates include a first guide plate and a second guide plate, said first guide plate extending from one aperture to the other aperture so as to substantially bisect said apertures, and said second guide plate being substantially perpendicular to said first guide plate so as to form a barrier separating said apertures in an approximate center of said pipe.

14. The apparatus as set forth in claim 13, wherein each guide plate extends from one side of said pipe to an opposite side thereof in an upper portion of said pipe, each guide plate dividing thereunder into two halves which taper in a downward direction toward the sides of said pipe and are integrated with said pipe.

15. The apparatus as set forth in claim 11, wherein each guide plate extends from one side of said pipe to an opposite side thereof in an upper portion of said pipe, each guide plate dividing thereunder into two halves which taper in a downward direction toward the sides of said pipe and are integrated with said pipe.

16. The apparatus as set forth in claim 11, wherein said air filtering apparatus filters air flowing into said water storing container through said air inlet and includes a check valve for opening and closing an air hole based on buoyancy, a force of rising water against a base of said check valve causing said valve to rise, closing said air hole and preventing further water flow into said water storing container.

* * * * *